US012232614B2

(12) United States Patent
Chen et al.

(10) Patent No.: US 12,232,614 B2
(45) Date of Patent: Feb. 25, 2025

(54) SLIDE RAIL ASSEMBLY

(71) Applicants: King Slide Works Co., Ltd., Kaohsiung (TW); King Slide Technology Co., Ltd., Kaohsiung (TW)

(72) Inventors: Ken-Ching Chen, Kaohsiung (TW); Shun-Ho Yang, Kaohsiung (TW); Tzu-Cheng Weng, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 179 days.

(21) Appl. No.: 18/152,832

(22) Filed: Jan. 11, 2023

(65) Prior Publication Data

US 2024/0068516 A1 Feb. 29, 2024

(30) Foreign Application Priority Data

Aug. 24, 2022 (TW) ..... 111132229

(51) Int. Cl.
*A47B 88/57* (2017.01)
*A47B 88/447* (2017.01)

(52) U.S. Cl.
CPC ..... *A47B 88/57* (2017.01); *A47B 88/447* (2017.01)

(58) Field of Classification Search
CPC ..... A47B 88/57; A47B 88/447
USPC ..... 312/334.1
See application file for complete search history.

(56) References Cited

U.S. PATENT DOCUMENTS

| | | | | |
|---|---|---|---|---|
| 6,145,945 | A | 11/2000 | Parvin | |
| 6,851,773 | B2 | 2/2005 | Chen et al. | |
| 7,648,214 | B2 | 1/2010 | Chen et al. | |
| 9,279,451 | B2 | 3/2016 | Judge | |
| 9,980,566 | B2 | 5/2018 | Chen et al. | |
| 10,743,658 | B1 * | 8/2020 | Chen | A47B 88/447 |
| 2008/0129170 | A1 * | 6/2008 | Peng | A47B 88/493 312/334.44 |
| 2018/0092462 | A1 * | 4/2018 | Chen | A47B 88/493 |

FOREIGN PATENT DOCUMENTS

CN 114847691 8/2022

* cited by examiner

*Primary Examiner* — James O Hansen
(74) *Attorney, Agent, or Firm* — Best & Flanagan LLP

(57) ABSTRACT

A slide rail assembly includes a first rail, a second rail, a slide assisting device, an elastic member and a working member. The second rail and the first rail are movable relative to each other. The elastic member is arranged on the second rail. During a process of the second rail being moved relative to the first rail along an opening direction, the working member is configured to contact the elastic member in an initial state in order to drive the slide assisting device to move along the opening direction to a predetermined position. When the slide assisting device is located at the predetermined position, the elastic member releases an elastic force through a predetermined space of the first rail, such that the elastic member is no longer in the initial state with the working member no longer contacting the elastic member.

20 Claims, 12 Drawing Sheets

SLIDE RAIL ASSEMBLY

BACKGROUND OF THE INVENTION

1. Field of the Invention

The present invention relates to a slide rail assembly, and more particularly, to a slide rail assembly capable of forcibly driving a slide assisting device to move to a predetermined position.

2. Description of the Prior Art

U.S. Pat. No. 9,980,566 B2 discloses a slide rail assembly, which comprises a first rail, a second rail, a blocking base, a ball retainer and a blocking member. The second rail is movable relative to the first rail. The blocking base is arranged on the first rail and has a limiting part. The ball retainer is configured to facilitate movement between the second rail and the first rail. The ball retainer has a contact part. The contact part of the ball retainer is a fixed portion (non-movable portion). The blocking member is configured to be operatively moved relative to the second rail from a first state to a second state. When the blocking member is in the first state, the blocking member is configured to push the contact part of the ball retainer to move the ball retainer in response to a movement of the second rail along an opening direction until the blocking member abuts against the limiting part of the blocking base. Meanwhile, an engagement feature of the ball retainer is engaged with an elastic arm on the blocking base of the first rail, such that the ball retainer can be temporarily held and stopped at a predetermined position, and the contact part of the ball retainer and the limiting part of the blocking base are separated from each other.

However, such separation requires more space. Once a manufacturing tolerance is over the limit, such as a specific dimension is too large or a specific position is too close, movement smoothness of the ball retainer will be affected. Therefore, for different market requirements, it is important to develop various products.

SUMMARY OF THE INVENTION

The present invention relates to a slide rail assembly capable of forcibly driving a slide assisting device to move to a predetermined position and ensuring movement smoothness of the slide assisting device.

According to an embodiment of the present invention, a slide rail assembly comprises a first rail, a second rail, a slide assisting device, an elastic member and a working member. The first rail comprises a blocking feature and is formed with a predetermined space. The second rail is longitudinally movable relative to the first rail. The slide assisting device is movably mounted between the first rail and the second rail. The elastic member is arranged on the slide assisting device. The working member is arranged on the second rail. During a process of the second rail being moved relative to the first rail along an opening direction, the working member is configured to contact the elastic member in an initial state in order to drive the slide assisting device to move along the opening direction to a predetermined position. When the slide assisting device is located at the predetermined position, the elastic member is configured to release an elastic force through the predetermined space of the first rail to be switched from the initial state to a non-initial state, such that the working member no longer contacts the elastic member in the non-initial state. When the second rail is further moved relative to the first rail along the opening direction to an extension position, the blocking feature of the first rail is configured to block the working member in order to prevent the second rail from being moved from the extension position along the opening direction.

Preferably, the first rail has a front part and a rear part, and the blocking feature is located adjacent to the front part of the first rail.

Preferably, the first rail comprises a first wall, a second wall and a longitudinal wall connected between the first wall and the second wall, and a passage is defined by the first wall, the second wall and the longitudinal wall of the first rail in order to accommodate the second rail.

Preferably, the slide assisting device is located inside the passage of the first rail. The slide assisting device comprises a main body and a plurality of rolling members arranged on the main body. The plurality of rolling members are configured to support the first rail and the second rail.

Preferably, the elastic member is arranged on the main body of the slide assisting device.

Preferably, the main body of the slide assisting device comprises a first part, a second part and a longitudinal part connected between the first part and the second part of the main body, and the plurality of rolling members are arranged on the first part and the second part of the main body.

Preferably, the elastic member comprises a connecting part, an elastic part and a predetermined part. The connecting part of the elastic member is connected to the longitudinal part of the main body. The elastic part is extended from the connecting part. The predetermined part is located on the elastic part. The elastic part is configured to be supported by the longitudinal wall of the first rail to hold the elastic member to be in the initial state to accumulate the elastic force. During the process of the second rail being moved relative to the first rail along the opening direction, the working member is configured to contact the predetermined part on the elastic part of the elastic member in order to drive the slide assisting device to move along the opening direction to the predetermined position. The longitudinal wall of the first rail is formed with the predetermined space. When the slide assisting device is located at the predetermined position, the elastic part of the elastic member releases the elastic force through the predetermined space of the longitudinal wall of the first rail, such that the elastic part of the elastic member is transversely moved to switch the elastic member from the initial state to the non-initial state, and the working member no longer contacts the predetermined part of the elastic part of the elastic member in the non-initial state.

Preferably, the elastic member and the main body are two independent components.

Preferably, the elastic member is integrated into the main body.

Preferably, the working member is movably mounted to the second rail. The slide rail assembly further comprises an operating member configured to be operated to move the working member.

Preferably, when the second rail is located at the extension position relative to the first rail, the blocking feature of the first rail is configured to block the working member in a first state in order to prevent the second rail from being moved from the extension position along the opening direction. The operating member is configured to drive the working member to switch from the first state to a second state, such that the blocking feature of the first rail no longer blocks the working member in order to allow the second rail to move from the extension position along the opening direction.

Preferably, the working member is pivotally connected to the second rail. The slide rail assembly further comprises an auxiliary base, and the auxiliary base comprises an elastic section. The working member is configured to be held in the first state in response to an elastic force of the elastic section.

According to another embodiment of the present invention, a slide rail assembly comprises a first rail, a second rail, an engaging member, a slide assisting device, an elastic member and a working member. The first rail is formed with a predetermined space. The second rail is movable relative to the first rail. The engaging member is arranged on the first rail. The slide assisting device is movably mounted between the first rail and the second rail. The elastic member is arranged on the slide assisting device. The working member is arranged on the second rail. During a process of the second rail being moved relative to the first rail along an opening direction, the working member is configured to contact the elastic member in an initial state in order to drive the slide assisting device to move along the opening direction to a predetermined position. When the slide assisting device is located at the predetermined position, the elastic member is configured to release an elastic force through the predetermined space of the first rail to be switched from the initial state to a non-initial state, such that the working member no longer contacts the elastic member in the non-initial state. When the second rail is further moved relative to the first rail along the opening direction, the engaging member is configured to engage with the slide assisting device.

Preferably, the first rail comprises a first wall, a second wall and a longitudinal wall connected between the first wall and the second wall of the first rail, and a passage is defined by the first wall, the second wall and the longitudinal wall of the first rail in order to accommodate the second rail.

Preferably, the slide assisting device is located inside the passage of the first rail. The slide assisting device comprises a main body and a plurality of rolling members arranged on the main body. The plurality of rolling members are configured to support the first rail and the second rail.

Preferably, the elastic member is arranged on the main body of the slide assisting device.

Preferably, the main body of the slide assisting device comprises a first part, a second part and a longitudinal part connected between the first part and the second part of the main body, and the plurality of rolling members are arranged on the first part and the second part of the main body.

Preferably, the elastic member comprises a connecting part, an elastic part and a predetermined part. The connecting part of the elastic member is connected to the longitudinal part of the main body. The elastic part is extended from the connecting part. The predetermined part is located on the elastic part. The elastic part is configured to be supported by the longitudinal wall of the first rail to hold the elastic member to be in the initial state to accumulate the elastic force.

Preferably, during the process of the second rail being moved relative to the first rail along the opening direction, the working member is configured to contact the predetermined part on the elastic part of the elastic member in order to drive the slide assisting device to move along the opening direction to the predetermined position.

Preferably, when the slide assisting device is located at the predetermined position, the elastic part of the elastic member releases the elastic force through the predetermined space of the first rail, such that the elastic part of the elastic member is transversely moved to switch the elastic member from the initial state to the non-initial state, and the working member no longer contacts the predetermined part of the elastic part of the elastic member in the non-initial state.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
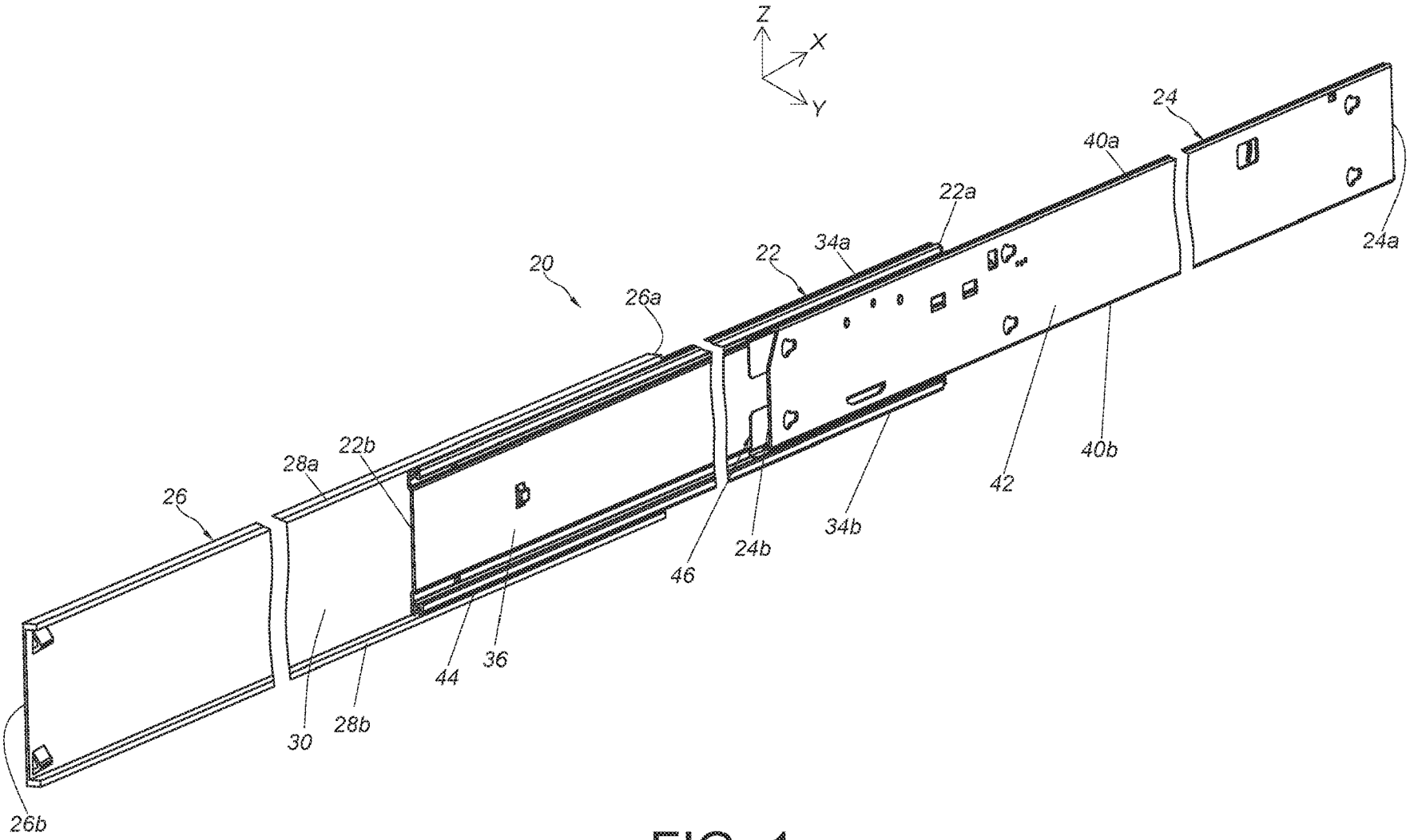
FIG. 1 is a diagram showing a slide rail assembly being in an extended state according to an embodiment of the present invention.
Figure 2:
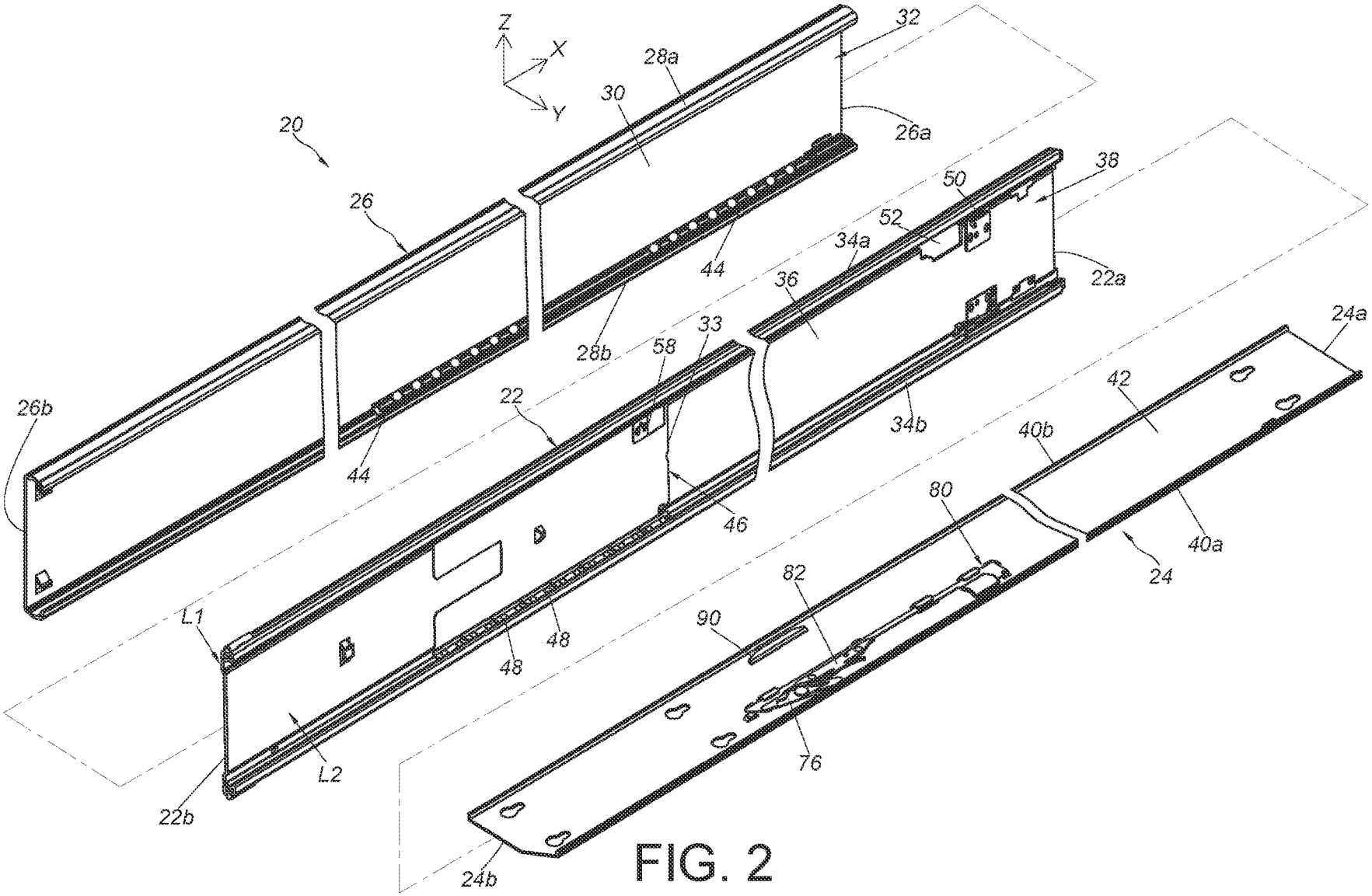
FIG. 2 is an exploded view of the slide rail assembly comprising a first rail, a second rail and a third rail according to an embodiment of the present invention.

As shown in FIG. 1 and FIG. 2, a slide rail assembly 20 comprises a first rail 22 and a second rail 24 according to an embodiment of the present invention. Preferably, the slide rail assembly 20 further comprises a third rail 26. The first rail 22 is movably mounted between the third rail 26 and the second rail 24, and the first rail 22 is configured to extend a traveling distance of the second rail 24 relative to the third rail 26. In the present embodiment, the third rail 26 (such as an outer rail), the first rail 22 (such as a middle rail) and the second rail 24 (such as an inner rail) are longitudinally movable relative to each other. In FIG. 1 and FIG. 2, the X axis is a longitudinal direction (or a length direction) of the slide rail assembly 20, the Y axis is a transverse direction (or a lateral direction) of the slide rail assembly 20, and the Z axis is a vertical direction (or a height direction) of the slide rail assembly 20.

The third rail 26 comprises a first wall 28*a*, a second wall 28*b* and a longitudinal wall 30 connected between the first wall 28*a* and the second wall 28*b* of the third rail 26. A passage 32 is defined by the first wall 28*a*, the second wall 28*b* and the longitudinal wall 30 of the third rail 26 in order to accommodate the first rail 22. The third rail 26 has a front part 26*a* and a rear part 26*b*.

The first rail 22 comprises a first wall 34*a*, a second wall 34*b* and a longitudinal wall 36 connected between the first wall 34*a* and the second wall 34*b* of the first rail 22. A passage 38 is defined by the first wall 34*a*, the second wall 34*b* and the longitudinal wall 36 of the first rail 22 in order to accommodate the second rail 24. The first rail 22 has a front part 22*a* and a rear part 22*b*.

The second rail 24 comprises a first wall 40*a*, a second wall 40*b* and a longitudinal wall 42 connected between the first wall 40*a* and the second wall 40*b* of the second rail 24. The second rail 24 has a front part 24*a* and a rear part 24*b*.

Preferably, at least one slide assisting member 44 is arranged in the passage 32 of the third rail 26. The slide assisting member 44 comprises a plurality of rolling balls to improve smoothness of relative movement between the first rail 22 and the third rail 26. On the other hand, the slide rail assembly 20 further comprises a slide assisting device 46 movably mounted between the first rail 22 and the second rail 24. Moreover, the slide assisting device 46 is arranged in the passage 38 of the first rail 22, and the slide assisting device 46 comprises a plurality of rolling members 48, such as rolling balls (please refer to FIG. 3), in order to improve smoothness of relative movement between the second rail 24 and the first rail 22.

Preferably, the slide assisting device 46 comprises a main body 33. The plurality of rolling members 48 are arranged on the main body 33 and configured to support the first rail 22 and the second rail 24.

Figure 3:
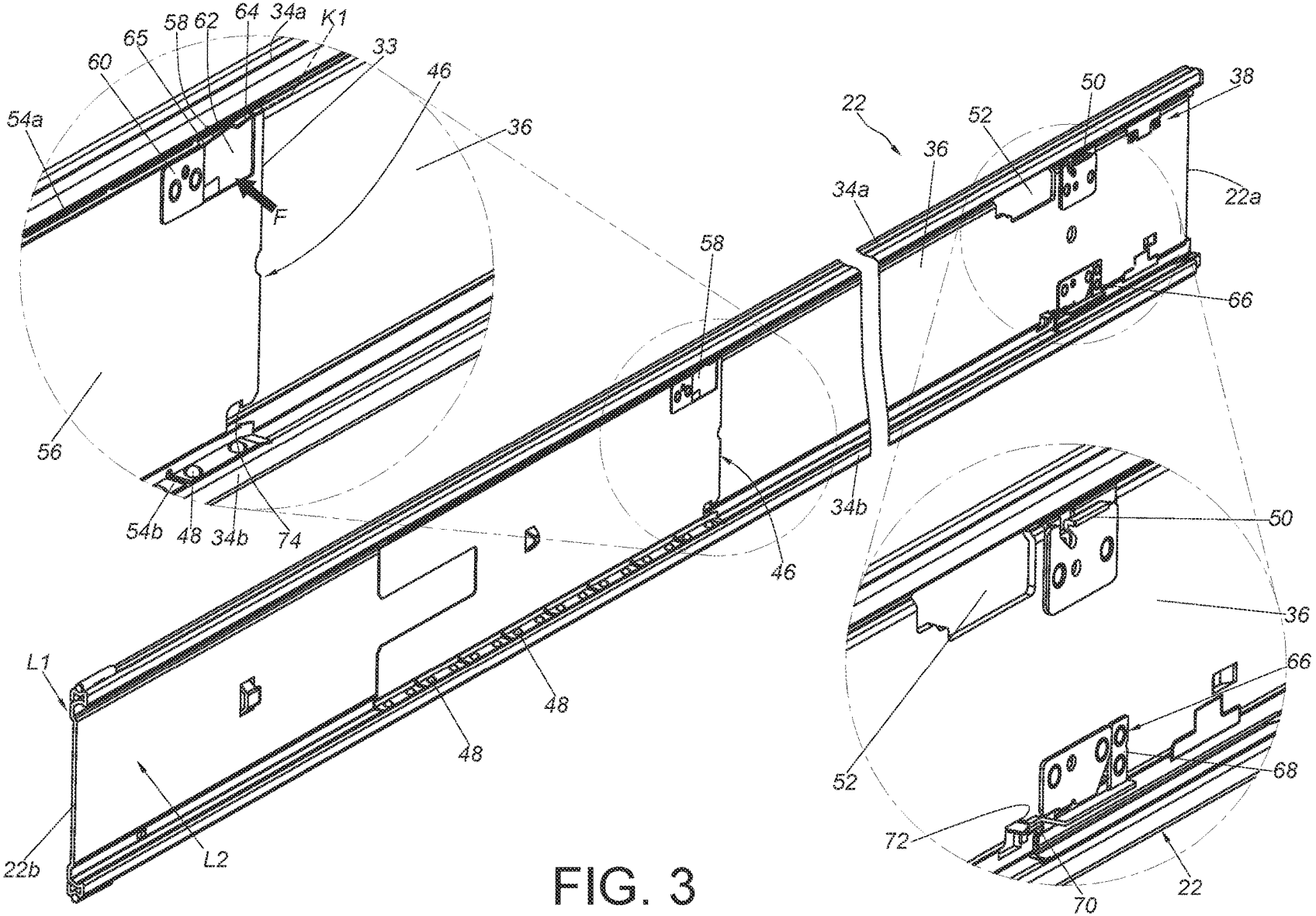
FIG. 3 is a diagram showing the first rail according to an embodiment of the present invention.

As shown in FIG. 3, the first rail 22 comprises a blocking feature 50 and is formed with a predetermined space 52. The blocking feature 50 is located inside the passage 38 of the first rail 22.

Preferably, the blocking feature 50, such as a protrusion part, is transversely (or laterally) protruded relative to the longitudinal wall 36 of the first rail 22, but the present invention is not limited thereto. In the present embodiment, the blocking feature 50 is located adjacent to the front part 22*a* of the first rail 22.

Preferably, the longitudinal wall 36 of the first rail 22 is formed with the predetermined space 52. For example, the longitudinal wall 36 of the first rail 22 comprises a groove to provide the predetermined space 52. Or, in the present embodiment, the predetermined space 52 is provided by an opening, but the present invention is not limited thereto. In the present embodiment, the predetermined space 52 is laterally communicated with a first side L1 and a second side L2 of the longitudinal wall 36 of the first rail 22. The first side L1 is opposite to the second side L2. The first side L1 of the longitudinal wall 36 of the first rail 22 faces the longitudinal wall 30 of the third rail 26, and the second side L2 of the longitudinal wall 36 of the first rail 22 faces the longitudinal wall 42 of the second rail 24 (please also refer to FIG. 1).

Preferably, the slide assisting device 46 is located inside the passage 38 of the first rail 22.

Preferably, the main body 33 of the slide assisting device 46 comprises a first part 54*a*, a second part 54*b* and a longitudinal part 56 connected between the first part 54*a* and the second part 54*b* of the main body 33. The plurality of rolling members 48 are arranged on the first part 54*a* and the second part 54*b* of the main body 33 (due to the viewing angle, FIG. 3 only shows the rolling members 48 on the second part 54*b* of the main body 33 without showing the rolling members 48 on the first part 54*a* of the main body 33). The first part 54*a*, the second part 54*b* and the longitudinal part 56 respectively correspond to the first wall 34*a*, the second wall 34*b* and the longitudinal wall 36 of the first rail 22.

The slide rail assembly 20 further comprises an elastic member 58 arranged on the main body 33 of the slide assisting device 46. In the present embodiment, the elastic member 58 and the main body 33 are two independent components, but the present invention is not limited thereto.

Preferably, the elastic member 58 is arranged on the longitudinal part 56 of the main body 33. The elastic member 58 comprises a connecting part 60, an elastic part 62 and a predetermined part 64. The connecting part 60 of the elastic member 58 is connected (such as fixedly connected) to the longitudinal part 56 of the main body 33. The elastic part 62 is extended from the connecting part 60, and the predetermined part 64 is located on the elastic part 62. The predetermined part 64 (such as a protrusion) is transversely protruded relative to the elastic part 62, but the present invention is not limited thereto. The elastic part 62 is configured to be supported by the longitudinal wall 36 of the first rail 22 to hold the elastic member 58 to be in an initial state K1 to accumulate an elastic force F.

Preferably, the longitudinal part 56 of the main body 33 is formed with a space 65 (such as an opening) communicating with two sides of the longitudinal part 56 of the main body 33. The elastic part 62 transversely penetrates through the space 65, so that the elastic part 62 is supported by the longitudinal wall 36 of the first rail 22 to hold the elastic member 58 to be in the initial state K1 and accumulate the elastic force F.

Preferably, the slide rail assembly 20 further comprises an engaging member 66 arranged on the first rail 22. The engaging member 66 comprises a fixed part 68 and an elastic arm 70. The fixed part 68 is fixed to the longitudinal wall 36 of the first rail 22. The elastic arm 70 is extended from the fixed part 68, and the elastic arm 70 comprises a fastening section 72. On the other hand, the main body 33 of the slide assisting device 46 further comprises a fastening part 74 configured to interact with the fastening section 72. The fastening part 74 is located adjacent to a front end of the main body 33, but the present invention is not limited thereto.

Figure 4:
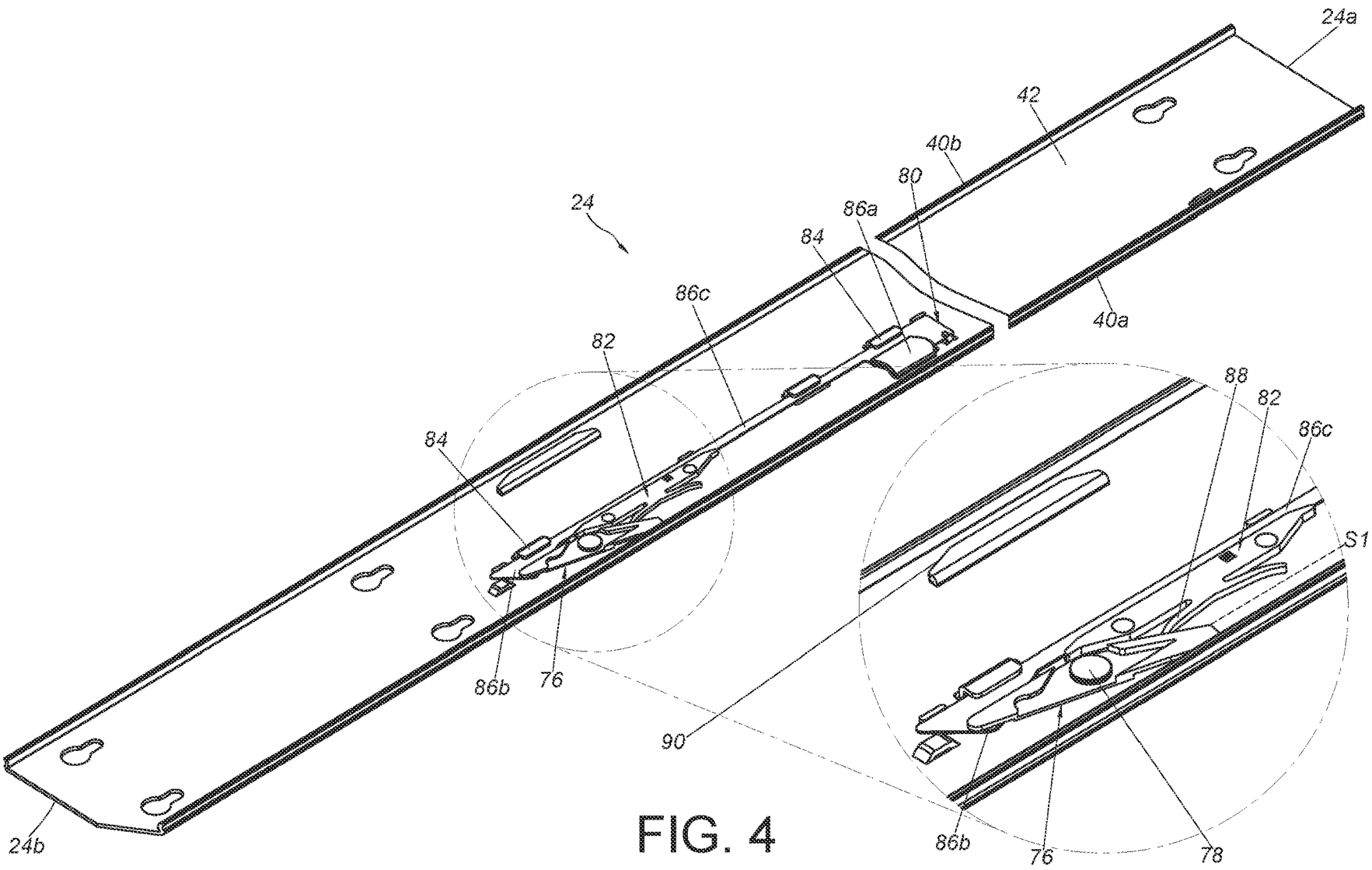
FIG. 4 is a diagram showing the second rail according to an embodiment of the present invention.

As shown in FIG. 4, the slide rail assembly 20 further comprises a working member 76 arranged on the second rail 24. Furthermore, the working member 76 is movably mounted to the second rail 24. In the present embodiment, the working member 76 is pivotally connected to the second rail 24 through a shaft member 78.

Preferably, the slide rail assembly 20 further comprises an operating member 80 and an auxiliary base 82. The operating member 80 is configured to be operated to move the working member 76. The operating member 80 is movably mounted to the second rail 24. For example, the operating member 80 is movable relative to the second rail 24 along the length direction of the second rail 24. The second rail 24 comprises at least one holding feature 84 configured to support the operating member 80 in order to improve stability when the operating member 80 is operated to move.

Preferably, the operating member 80 comprises an operating part 86*a*, a driving part 86*b* and an extension part 86*c* connected between the operating part 86*a* and the driving part 86*b*.

Preferably, the auxiliary base 82 is arranged on the second rail 24, and the auxiliary base 82 is configured to provide an elastic force to the working member 76. In the present embodiment, the auxiliary base 82 comprises an elastic section 88 configured to provide the elastic force to the working member 76. The working member 76 is held in a first state S1 in response to the elastic force of the elastic section 88.

Figure 5:
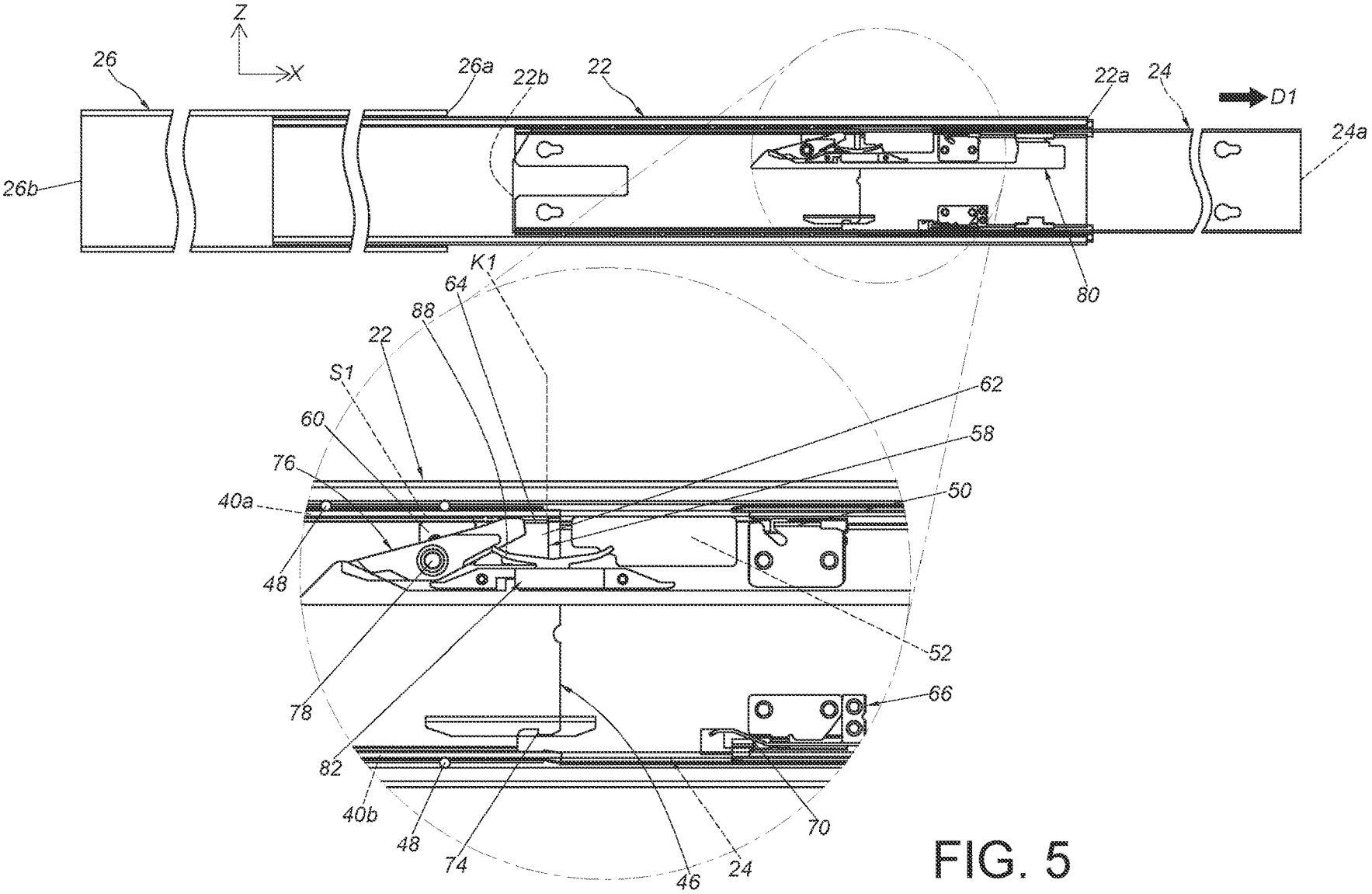
FIG. 5 is a diagram showing the first rail being extended relative to the third rail, and the second rail being moved relative to the first rail along an opening direction according to an embodiment of the present invention.

As shown in FIG. 5, the first rail 22 is extended relative to the third rail 26, and the front part 22*a* of the first rail 22 is extended beyond the front part 26*a* of the third rail 26. The working member 76 is held in the first state S1 in response to the elastic force of the elastic section 88 of the auxiliary base 82.

Figure 6:
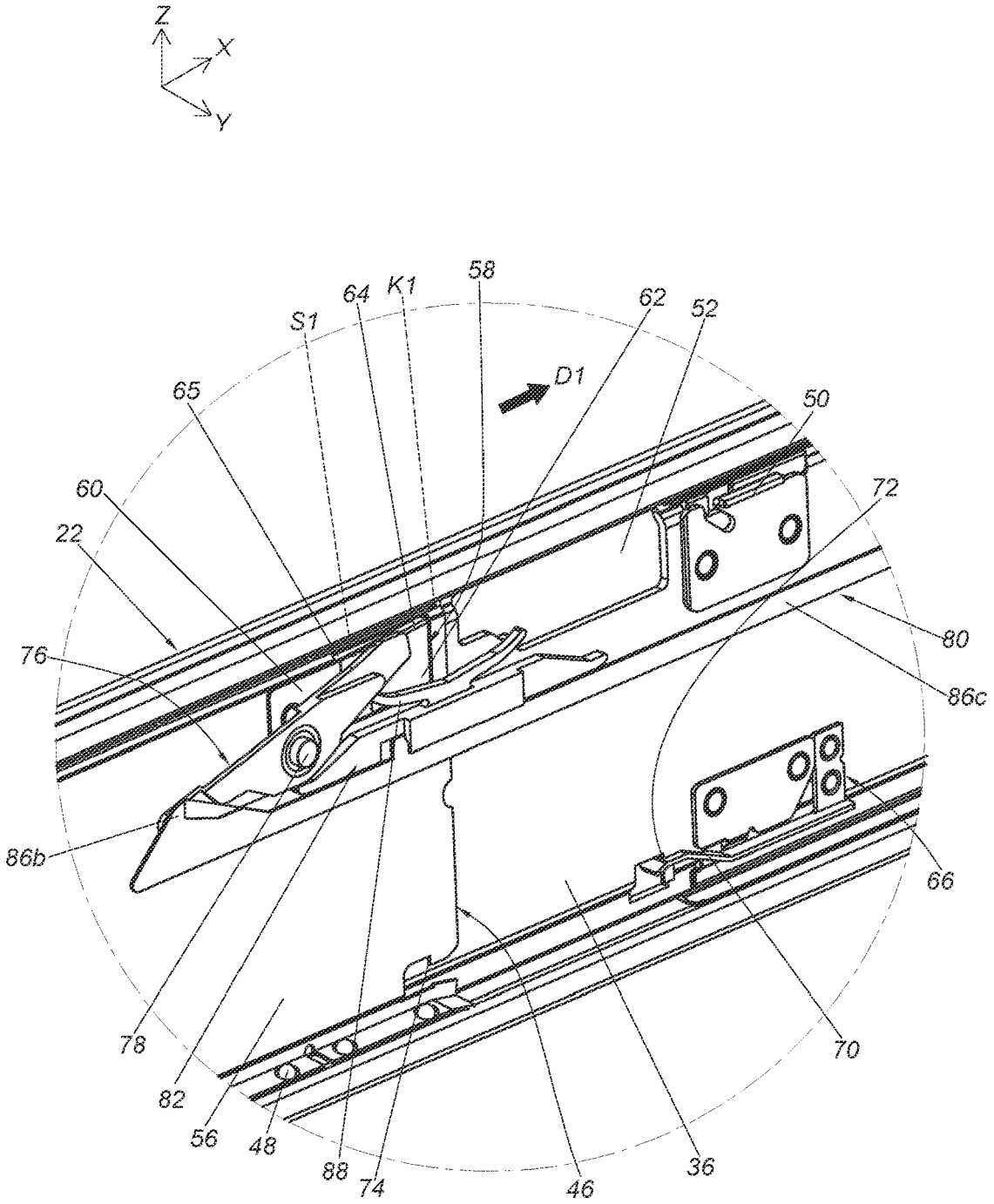
FIG. 6 is a partial diagram showing a working member on the second rail being moved along the opening direction to drive a slide assisting device to move through an elastic member according to an embodiment of the present invention.
Figure 7:
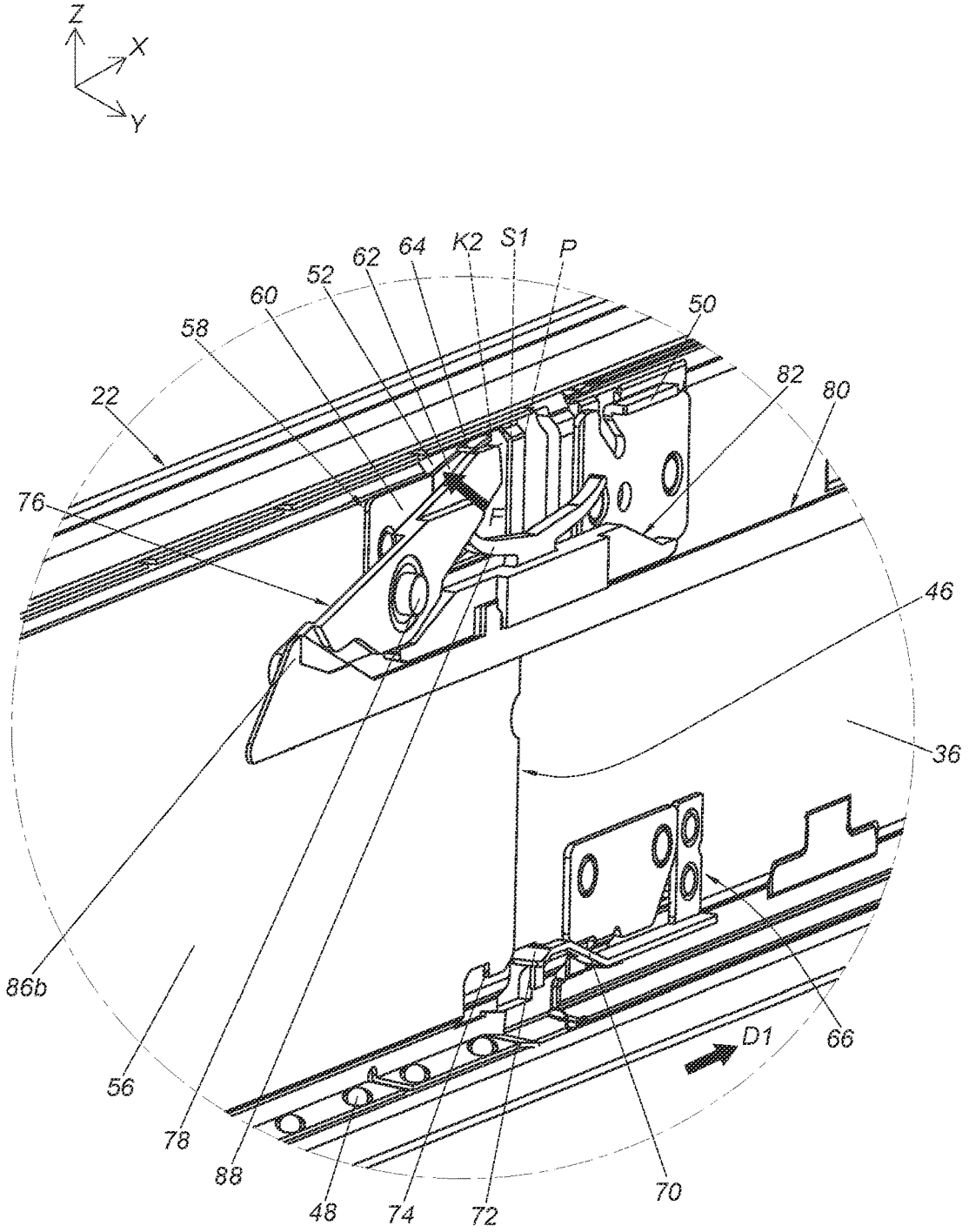
FIG. 7 is a partial diagram showing the working member on the second rail being separated from the elastic member to no longer drive the slide assisting device to move according to an embodiment of the present invention.

As shown in FIG. 5, FIG. 6 and FIG. 7, during a process of the second rail 24 (the second rail 24 is omitted in FIG. 6 and FIG. 7) being moved relative to the first rail 22 from a retracted position along an opening direction D1, the working member 76 in the first state S1 is configured to contact the predetermined part 64 of the elastic member 58 in the initial state K1 (as shown in FIG. 5 and FIG. 6), in order to forcibly drive the slide assisting device 46 to move along the opening direction D1 to a predetermined position P (as shown in FIG. 7). When the slide assisting device 46 is located at the predetermined position P, the elastic member 58 releases the elastic force F through the predetermined space 52 of the first rail 22 (the elastic part 62 of the elastic member 58 transversely extended into the predetermined space 52 of the first rail 22) to be switched from the initial state K1 (as shown in FIG. 5 and FIG. 6) to a non-initial state K2 (as shown in FIG. 7), such that the working member 76 no longer contacts the elastic member 58.

Moreover, during the process of the second rail 24 being moved relative to the first rail 22 along the opening direction D1, the working member 76 is configured to contact the predetermined part 64 on the elastic part 62 of the elastic member 58 (as shown in FIG. 5 and FIG. 6) in order to forcibly drive the slide assisting device 46 to move along the opening direction D1, such that the slide assisting device 46 can be ensured to be close to the front part 22*a* of the first rail 22. Thereby, the first wall 40*a* and the second wall 40*b* of a predetermined section (such as a middle section and/or a rear section, but the present invention is not limited thereto) of the second rail 24 can be properly supported by the slide assisting device 46 (the rolling members 48 of the slide assisting device 46) as shown in FIG. 5.

When the slide assisting device 46 is forcibly driven to move to the predetermined position P (as shown in FIG. 7), the elastic part 62 of the elastic member 58 releases the elastic force F through the predetermined space 52 of the longitudinal wall 36 of the first rail 22, such that the elastic part 62 of the elastic member 58 is transversely (or laterally) moved to switch the elastic member 58 from the initial state K1 (as shown in FIG. 5 and FIG. 6) to the non-initial state K2 (as shown in FIG. 7). Therefore, the working member 76 is separated from the predetermined part 64 on the elastic part 62 of the elastic member 58, such that the working member 76 no longer contacts the predetermined part 64 on the elastic part 62 of the elastic member 58.

Figure 8:
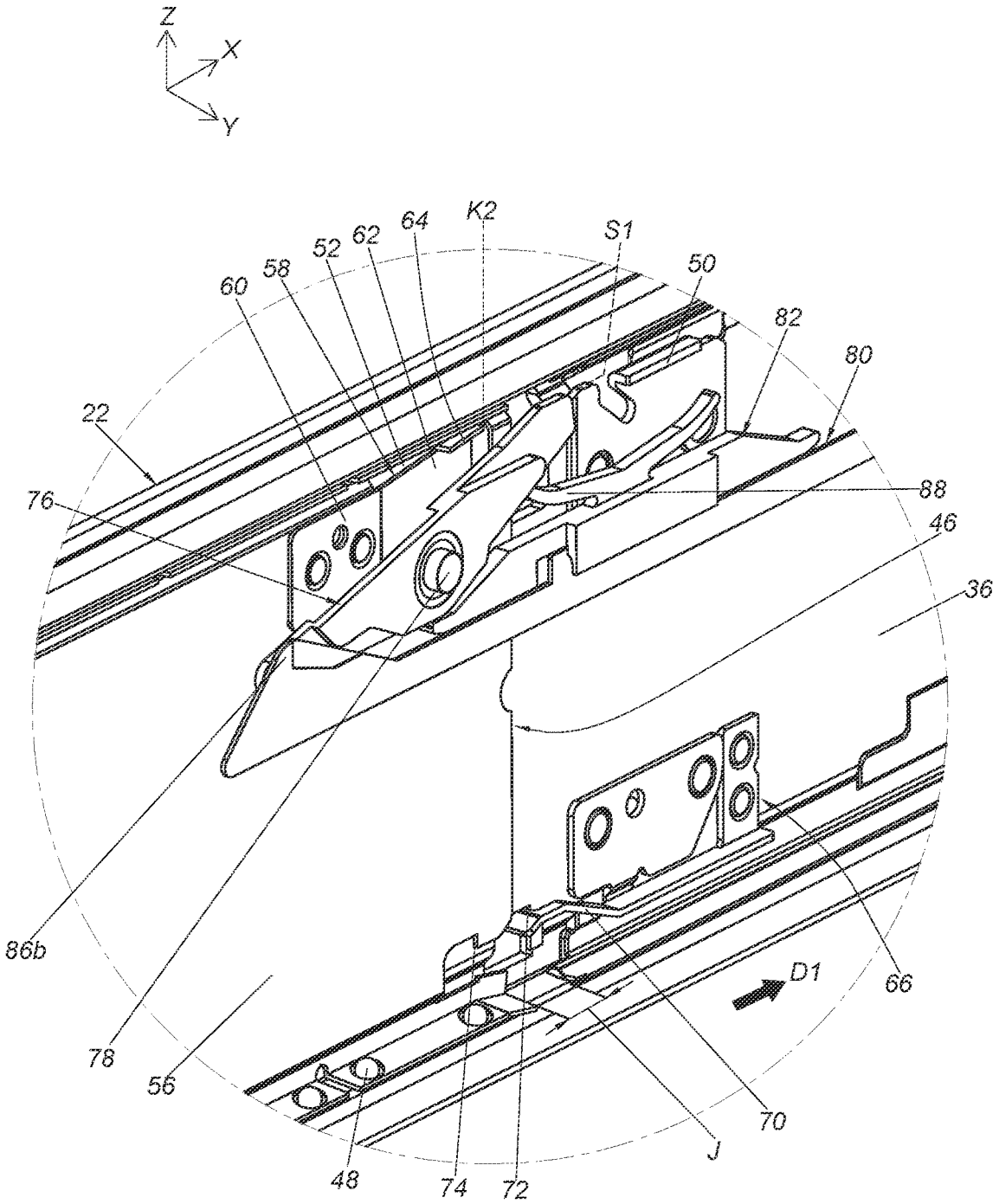
FIG. 8 is a partial diagram showing the working member on the second rail being separated from the elastic member to no longer drive the slide assisting device to move according to an embodiment of the present invention.
Figure 9:
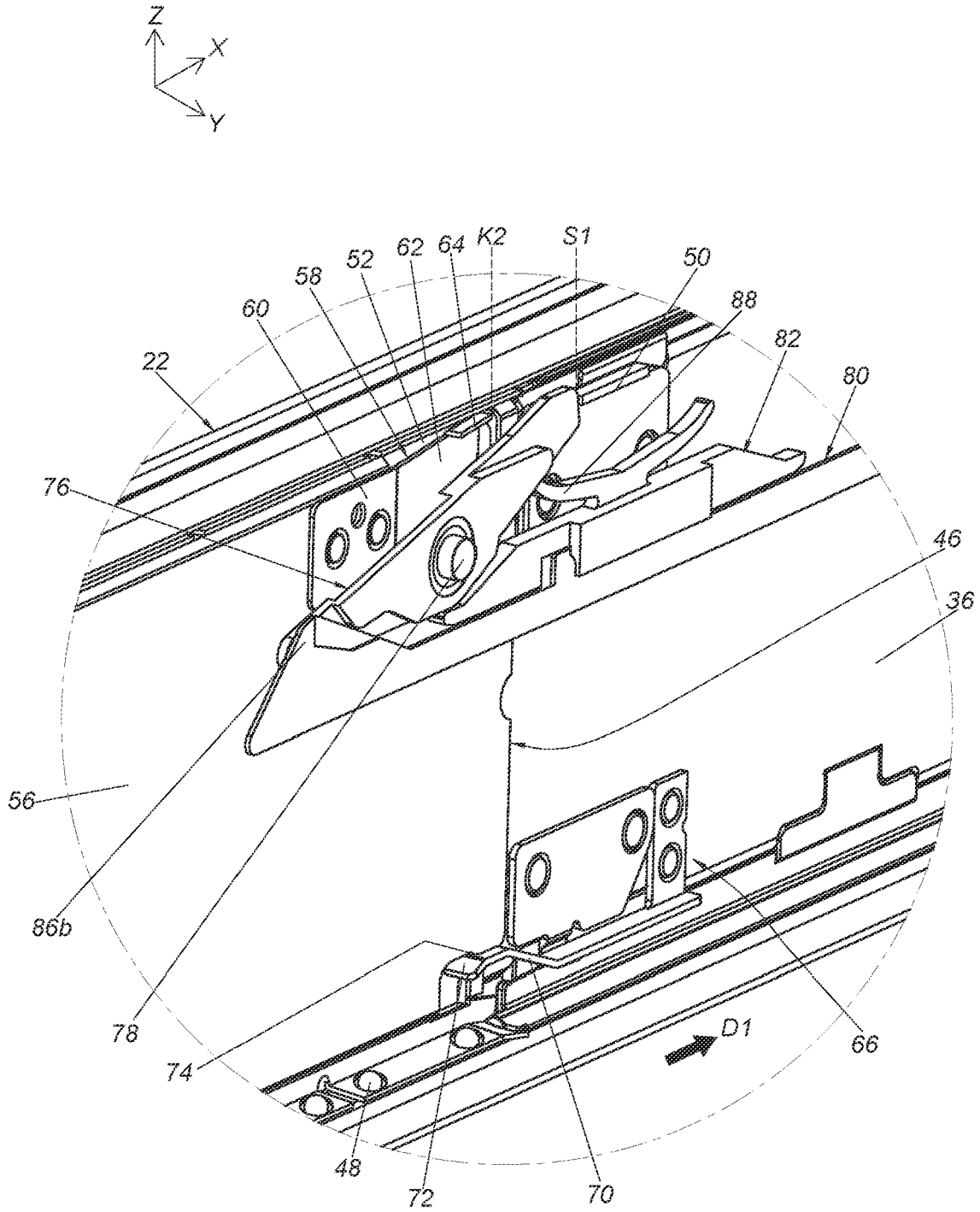
FIG. 9 is a partial diagram showing a blocking feature on the first rail configured to block the working member on the second rail according to an embodiment of the present invention.
Figure 10:
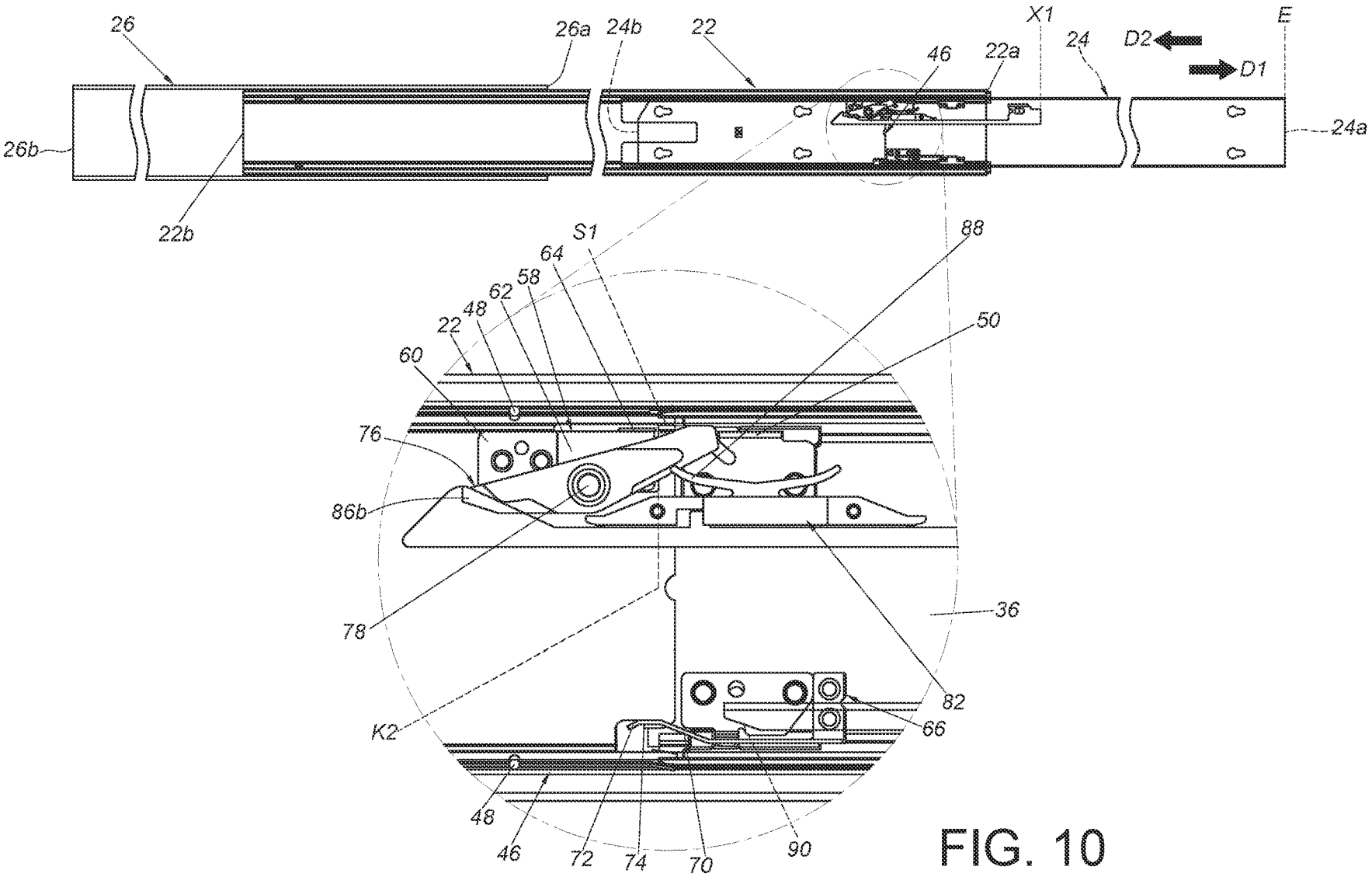
FIG. 10 is a diagram showing the slide rail assembly being in the extended state with the blocking feature blocking the working member according to an embodiment of the present invention.

As shown in FIG. 8, FIG. 9 and FIG. 10, when the second rail 24 (the second rail 24 is omitted in FIG. 8 and FIG. 9) is further moved relative to the first rail 22 along the opening direction D1 to an extension position E, the blocking feature 50 of the first rail 22 is configured to block the working member 76 in the first state S1, in order to prevent the second rail 24 from being moved from the extension position E along the opening direction D1 (as shown in FIG. 9 and FIG. 10).

Preferably, when the second rail 24 is further moved relative to the first rail 22 along the opening direction D1 to the extension position E, the slide assisting device 46 is moved (differentially moved) along with the second rail 24 along the opening direction D1 by a predetermined distance J (as shown in FIG. 8 and FIG. 9), such that the engaging member 66 (the fastening section 72 of the engaging member 66) is configured to engage with the slide assisting device 46 (the fastening part 74 of the slide assisting device 46) to temporarily hold the slide assisting device 46 at a position close to the front part 22*a* of the first rail 22 (as shown in FIG. 10).

Moreover, the aforementioned differential movement is a movement of the rolling members 48 of the slide assisting device 46 being driven to roll in response to the movement of the second rail 24 relative to the first rail 22, so that displacement of the slide assisting device 46 is smaller than actual displacement of the second rail 24. Such configuration is well known to those skilled in the art, for simplification, no further illustration is provided.

In addition, the second rail 24 can be moved relative to the first rail 22 from the extension position E along a retraction direction D2. During a process of the second rail 24 being moved from the extension position E along the retraction direction D2, the engaging member 66 (the fastening section 72 of the engaging member 66) can be disengaged from the slide assisting device 46 (the fastening part 74 of the slide assisting device 46) through a predetermined feature 90 or a predetermine portion of the second rail 24 (such as an inclined surface or an arc surface as shown in FIG. 10). For example, the predetermined feature 90 is configured to drive the elastic arm 70 of the engaging member 66 to deflect, in order to disengage the engaging member 66 (the fastening section 72 of the engaging member 66) from the slide assisting device 46 (the fastening part 74 of the slide assisting device 46). Such configuration is well known to those skilled in the art, for simplification, no further illustration is provided. Moreover, after the engaging member 66 (the fastening section 72 of the engaging member 66) is disengaged from the slide assisting device 46 (the fastening part 74 of the slide assisting device 46), the rolling members 48 of the slide assisting device 46 is configured to be driven to roll in response to movement of the second rail 24 along the retraction direction D2, such that the slide assisting device 46 is moved (differentially moved) along the retraction direction D2. During such process, the elastic member 58 (the elastic part 62 of the elastic member 58) is configured to be moved away from the predetermined space 52 of the first rail 22 to return to the initial state K1 from the non-initial state K2.

Figure 11:
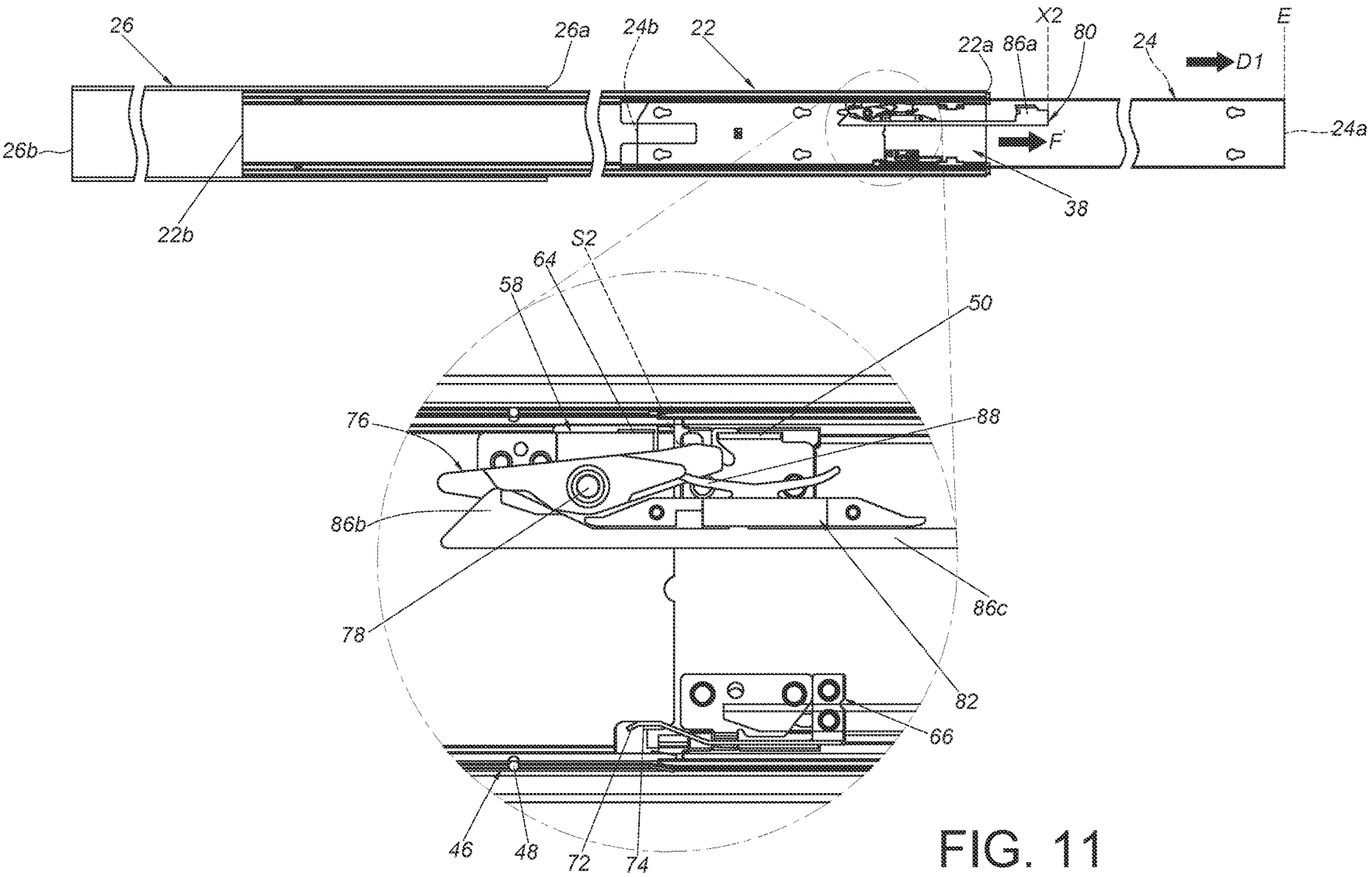
FIG. 11 is a diagram showing the slide rail assembly being in the extended state with the blocking feature no longer blocking the working member according to an embodiment of the present invention.

As shown in FIG. 10 and FIG. 11, the operating member 80 is configured to be operated to drive the working member 76 to switch from the first state S1 (as shown in FIG. 10) to a second state S2 (as shown in FIG. 11), such that the blocking feature 50 of the first rail 22 no longer blocks the working member 76 in order to allow the second rail 24 to move from the extension position E along the opening direction D1.

Moreover, a user can apply an operating force F' to the operating part 86*a* of the operating member 80 to move the operating member 80 from a first operating position X1 (as shown in FIG. 10) to a second operating position X2 (as shown in FIG. 11), such that driving part 86*b* of the operating member 80 is configured to drive the working member 76 to rotate from the first state S1 (as shown in FIG. 10) to the second state S2 (as shown in FIG. 11). Therefore, the blocking feature 50 of the first rail 22 no longer blocks the working member 76, so as to allow the second rail 24 to move from the extension position E along the opening direction D1 to be detached from the passage 38 of the first rail 22 (as shown in FIG.

Figure 12:
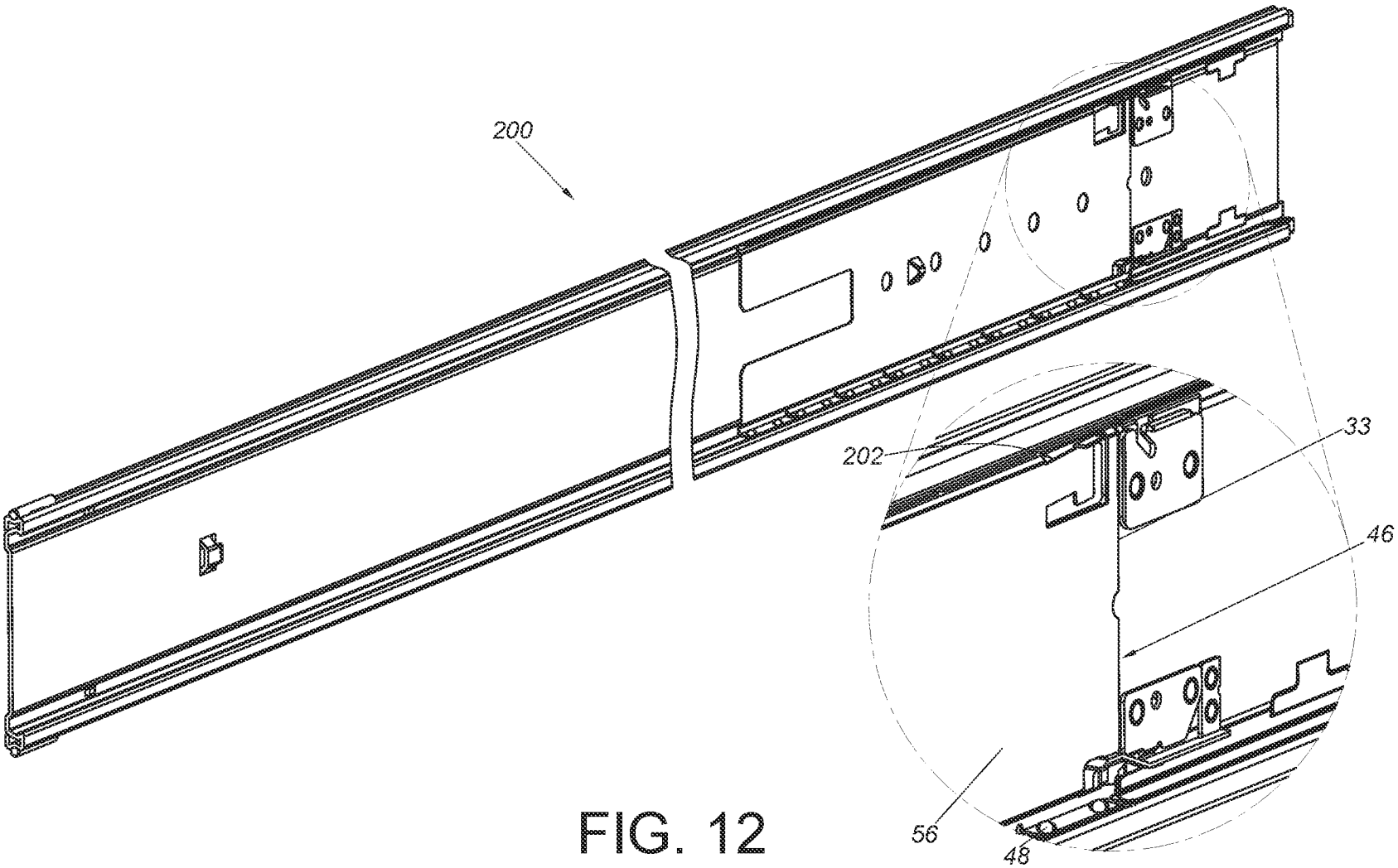
FIG. 12 is a diagram showing the slide assisting device of the first rail according to another embodiment of the present invention.

FIG. 12 shows a first rail 200 according to another embodiment of the present invention. Different from the first rail 22, the first rail 200 is configured to have an elastic member 202 being integrated to the main body 33 of the slide assisting device 46. Such configuration can achieve the same technical effect as the aforementioned embodiment.

Therefore, the slide rail assembly 20 according to the embodiment of the present invention has the following technical features:

1. During the process of the second rail 24 being moved relative to the first rail 22 along the opening direction D1, the working member 76 is configured to contact the elastic member 58 to forcibly drive the slide assisting device 46 to move along the opening direction D1 to a predetermined position, such that the slide assisting device 46 can be ensured to be close to the front part 22*a* of the first rail 22. Thereby, the predetermined section of the second rail 24 can be properly supported by the slide assisting device 46 (the rolling members 48 of the slide assisting device 46) to provide effective slide assisting effect to the second rail 24.
2. The first rail 22 (the longitudinal wall 36 of the first rail 22) is formed with the predetermined space 52. The elastic member 58 is arranged on the slide assisting device 46. The elastic member 58 is configured to release the elastic force F through the predetermined space 52 of the first rail 22 to be switched (such as transversely moved) from the initial state K1 to the non-initial state K2, such that the working member 76 no longer contacts the elastic member 58.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly comprising:

a first rail comprising a blocking feature and being formed with a predetermined space wherein the first rail comprises a first wall, a second wall and a longitudinal wall connected between the first wall and the second wall of the first rail, the predetermined space is provided by an opening formed on the longitudinal wall of the first rail, and the predetermined space is transversely communicated with a first side and a second side of the longitudinal wall of the first rail, the first side is opposite to the second side;

a second rail longitudinally movable relative to the first rail;

a slide assisting device movably mounted between the first rail and the second rail;

an elastic member arranged on the slide assisting device; and a working member arranged on the second rail;

wherein while the second rail is moved relative to the first rail along an opening direction, the working member is configured to contact the elastic member in an initial state in order to drive the slide assisting device to move along the opening direction to a predetermined position;

wherein when the slide assisting device is located at the predetermined position, the elastic member is configured to be transversely extended into the predetermined space provided by the opening formed on the longitudinal wall of the first rail in order to release an elastic force through the predetermined space of the first rail to be switched from the initial state to a non-initial state, such that the working member no longer contacts the elastic member in the non-initial state;

wherein when the second rail is further moved relative to the first rail along the opening direction to an extension position, the blocking feature of the first rail is configured to block the working member in order to prevent the second rail from being moved from the extension position along the opening direction.

2. The slide rail assembly of claim 1, wherein the first rail has a front part and a rear part, and the blocking feature is located adjacent to the front part of the first rail.

3. The slide rail assembly of claim 1, wherein a passage of the first rail is defined by the first wall, the second wall and the longitudinal wall of the first rail in order to accommodate the second rail.

4. The slide rail assembly of claim 3, wherein the slide assisting device is located inside the passage of the first rail; the slide assisting device comprises a main body and a plurality of rolling members arranged on the main body, and the plurality of rolling members are configured to support the first rail and the second rail.

5. The slide rail assembly of claim 4, wherein the elastic member is arranged on the main body of the slide assisting device.

6. The slide rail assembly of claim 5, wherein the main body of the slide assisting device comprises a first part, a second part and a longitudinal part connected between the first part and the second part of the main body, and the plurality of rolling members are arranged on the first part and the second part of the main body.

7. The slide rail assembly of claim 6, wherein the elastic member comprises a connecting part, an elastic part and a predetermined part; the connecting part of the elastic member is connected to the longitudinal part of the main body, the elastic part is extended from the connecting part, and the predetermined part is located on the elastic part; wherein the elastic part is configured to be supported by the longitudinal wall of the first rail to hold the elastic member to be in the initial state to accumulate the elastic force; wherein during the process of the second rail being moved relative to the first rail along the opening direction, the working member is configured to contact the predetermined part on the elastic part of the elastic member in order to drive the slide assisting device to move along the opening direction to the predetermined position; wherein when the slide assisting device is located at the predetermined position, the elastic part of the elastic member releases the elastic force through the predetermined space of the longitudinal wall of the first rail, such that the elastic part of the elastic member is transversely moved to switch the elastic member from the initial state to the non-initial state, and the working member no longer contacts the predetermined part of the elastic part of the elastic member in the non-initial state.

8. The slide rail assembly of claim 7, wherein the elastic member and the main body are two independent components.

9. The slide rail assembly of claim 7, wherein the elastic member is integrated into the main body.

10. The slide rail assembly of claim 1, wherein the working member is movably mounted to the second rail, and the slide rail assembly further comprises an operating member configured to be operated to move the working member.

11. The slide rail assembly of claim 10, wherein when the second rail is located at the extension position relative to the first rail, the blocking feature of the first rail is configured to block the working member in a first state in order to prevent the second rail from being moved from the extension position along the opening direction; wherein the operating member is configured to drive the working member to switch from the first state to a second state, such that the blocking feature of the first rail no longer blocks the working member in order to allow the second rail to move from the extension position along the opening direction.

12. The slide rail assembly of claim 11, wherein the working member is pivotally connected to the second rail, the slide rail assembly further comprises an auxiliary base, and the auxiliary base comprises an elastic section; the working member is configured to be held in the first state in response to an elastic force of the elastic section.

13. A slide rail assembly comprising:

a first rail formed with a predetermined space wherein the first rail comprises a first wall, a second wall and a longitudinal wall connected between the first wall and the second wall of the first rail, the predetermined space is provided by an opening formed on the longitudinal wall of the first rail, and the predetermined space is transversely communicated with a first side and a second side of the longitudinal wall of the first rail, the first side is opposite to the second side;

a second rail movable relative to the first rail;

an engaging member arranged on the first rail;

a slide assisting device movably mounted between the first rail and the second rail;

an elastic member arranged on the slide assisting device; and a working member arranged on the second rail;

wherein while the second rail is moved relative to the first rail along an opening direction, the working member is configured to contact the elastic member in an initial state in order to drive the slide assisting device to move along the opening direction to a predetermined position;

wherein when the slide assisting device is located at the predetermined position, the elastic member is configured to be transversely extended into the predetermined space provided by the opening formed on the longitudinal wall of the first rail in order to release an elastic force through the predetermined space of the first rail to be switched from the initial state to a non-initial state, such that the working member no longer contacts the elastic member in the non-initial state;

wherein when the second rail is further moved relative to the first rail along the opening direction, the engaging member is configured to engage with the slide assisting device.

14. The slide rail assembly of claim 13, wherein a passage of the first rail is defined by the first wall, the second wall and the longitudinal wall of the first rail in order to accommodate the second rail.

15. The slide rail assembly of claim 14, wherein the slide assisting device is located inside the passage of the first rail; the slide assisting device comprises a main body and a plurality of rolling members arranged on the main body, and the plurality of rolling members are configured to support the first rail and the second rail.

16. The slide rail assembly of claim 15, wherein the elastic member is arranged on the main body of the slide assisting device.

17. The slide rail assembly of claim 16, wherein the main body of the slide assisting device comprises a first part, a second part and a longitudinal part connected between the first part and the second part of the main body, and the plurality of rolling members are arranged on the first part and the second part of the main body.

18. The slide rail assembly of claim 17, wherein the elastic member comprises a connecting part, an elastic part and a predetermined part; the connecting part of the elastic member is connected to the longitudinal part of the main body, the elastic part is extended from the connecting part, and the predetermined part is located on the elastic part; wherein the elastic part is configured to be supported by the longitudinal wall of the first rail to hold the elastic member to be in the initial state to accumulate the elastic force.

19. The slide rail assembly of claim 18, wherein during the process of the second rail being moved relative to the first rail along the opening direction, the working member is configured to contact the predetermined part on the elastic part of the elastic member in order to drive the slide assisting device to move along the opening direction to the predetermined position.

20. The slide rail assembly of claim 19, wherein when the slide assisting device is located at the predetermined position, the elastic part of the elastic member releases the elastic force through the predetermined space of the first rail, such that the elastic part of the elastic member is transversely moved to switch the elastic member from the initial state to the non-initial state, and the working member no longer contacts the predetermined part of the elastic part of the elastic member in the non-initial state.

* * * * *